US006360396B1

(12) United States Patent
Chao

(10) Patent No.: US 6,360,396 B1
(45) Date of Patent: Mar. 26, 2002

(54) TRACTOR IMPLEMENT FOR SCRUBBING PAVEMENT

(76) Inventor: Victor V. Chao, P.O. Box 50001, Bellevue, WA (US) 98015

( * ) Notice: Subject to any disclaimer, the term of this patent is extended or adjusted under 35 U.S.C. 154(b) by 0 days.

(21) Appl. No.: 09/238,679

(22) Filed: Jan. 26, 1999

(51) Int. Cl.[7] ..... E01H 1/05
(52) U.S. Cl. ..... 15/82; 15/78
(58) Field of Search ..... 15/78, 79.2, 82

(56) References Cited

U.S. PATENT DOCUMENTS

| | | | | |
|---|---|---|---|---|
| 1,759,687 A | * | 5/1930 | Carter | 15/78 |
| 2,248,012 A | * | 7/1941 | Phillips | 15/78 |
| 2,259,632 A | | 10/1941 | Grace | |
| 2,711,551 A | * | 6/1955 | Wagner | 15/82 |
| 3,071,793 A | | 1/1963 | Lull | |
| 3,212,118 A | * | 10/1965 | Anderson | 15/82 |
| 3,624,853 A | | 12/1971 | Kromer | |
| 3,726,109 A | | 4/1973 | Mortensen | |
| 3,837,030 A | | 9/1974 | Liebrecht | |
| 4,619,463 A | | 10/1986 | Weaver | |
| 4,891,858 A | | 1/1990 | Wachter | |
| 4,926,517 A | | 5/1990 | Smith | |
| 5,279,014 A | | 1/1994 | Wise | |
| 5,369,832 A | | 12/1994 | Hagger | |
| 5,426,805 A | | 6/1995 | Fisher | |
| 5,515,568 A | | 5/1996 | Larson | |
| 5,560,065 A | | 10/1996 | Young | |
| 5,742,967 A | | 4/1998 | Giessler | |

FOREIGN PATENT DOCUMENTS

| | | | | |
|---|---|---|---|---|
| EP | 0372258 | * | 6/1990 | 15/82 |
| GB | 1283362 | * | 7/1972 | 15/82 |
| SU | 0700587 | * | 12/1979 | 15/82 |

* cited by examiner

*Primary Examiner*—Randall E. Chin
(74) *Attorney, Agent, or Firm*—David L. Tingey

(57) ABSTRACT

A tractor pavement-scrubbing implement having a rotating transverse cylindrical short-bristle brush attachable to a 3-point tractor hitch such that the brush may be lifted off the pavement surface or may be lowered against the pavement surface by the hydraulically-actuated 3-point hitch. The implement rides on wheels on each side of the transverse implement with the brush mounted forward of the wheels. Thus, when the hitch is lowered or lifted by the tractor 3-point hitch, the implement pivots on its rearward wheels. The implement comprises a first rotatable cylindrical brush mounted transverse in the implement adapted to rotate counterclockwise opposite the direction of travel for increased scrubbing action. Optionally, a second cylindrical brush parallel and axially offset from the first is included, rotating counter to rotation of the first brush clockwise to provide opposite scrubbing action complementary to the first brush. The brush or brushes are driven by a tractor power take-off drive. A magnetic bar may be attached transversely rearward of the housing disposed close to but spaced apart from the pavement to collect iron debris on the pavement.

14 Claims, 7 Drawing Sheets

TRACTOR IMPLEMENT FOR SCRUBBING PAVEMENT

BACKGROUND OF THE INVENTION

1. Field of the Invention

This invention relates to tractor implements, and particularly, to an implement for scrubbing pavement attachable rearward of the tractor on a 3-point hinge hitch.

2. Prior Art

Independently-motored street sweepers are well-known. Likewise, various plows and sweepers mountable forward of a drive vehicle are known as are sweeper attachments mounted rearward of a drive vehicle. These sweepers comprise long bristle brushes adjusted to slightly contact a street surface so as to minimize brush wear yet still impel street litter into a collection mechanism. It is unknown to have a rotating brush tractor implement removably towable behind a tractor and that has substantially nonpliable brush bristles sufficient to scrub a street or runway surface to remove materials adhering to pavement, typically of asphalt or concrete, such as tire rubber as opposed to only materials generally loose on the surface.

Thus, it is an object of the present invention to have a towable scrubber. It is a further object that the scrubber include substantially nonpliable brush bristles suitable for scrubbing rather than light sweeping. It is further object that the scrubber be towable by a category I or II tractor. It is yet another object that the scrubber be adjustable in height such that it can be lifted off the asphalt or concrete pavement surface or lowered to increase force on the brush bristles for augmented scrubbing action. It is still another object that the scrubber optionally comprise two parallel cylindrical scrub brushes acting in series.

SUMMARY OF THE INVENTION

These and other objects are achieved in a tractor pavement-scrubbing implement with a rotating transverse cylindrical brush adapted to attach to a 3-point hitch, two opposite transverse points and an elevated central point dividing the transverse points for lifting and lowering the implement. Thus, the brush may be lifted off the pavement surface or may be lowered, even pushed to the pavement surface, by the 3-point hitch. When the upper hitch point is actuated the implement is rotated forward, or clockwise, thereby lowering the brush onto the pavement surface. The brush can further be lifted or lowered to or from the pavement surface by lifting the tractor transverse points, typically hydraulically actuated hitch attachment members. Typically, the implement rides on wheels on each side of the transverse implement with the brush mounted forward of the wheels. Thus, when the hitch is lowered or lifted by the tractor 3-point hitch, the implement pivots on its rearward wheels.

The implement comprises a first rotatable cylindrical brush mounted transverse in the implement adapted to rotate counterclockwise opposite the rotation of the supporting wheels and the direction of travel for increased scrubbing action. The brush bristles are characteristically shorter than a sweeping brush having length between 2 and 3½ inches on a brush 14 to 20 inches in diameter for a brush bristle to brush diameter of approximately 7 to 1. Thus, the bristles are stiffer than sweeper bristles and suitable for scrubbing. The brush bristles may be steel or stiff plastic. Together, this provides a stiff brush suitable for scrubbing as opposed to sweeping, which is commonly achieved with much longer, pliable bristles.

Optionally, a second cylindrical brush parallel and axially offset from the first is included, rotating counter to rotation of the first brush clockwise to provide opposite scrubbing action complementary to the first brush.

There is no motor on the implement, either to propel the implement or to drive the brushes. Rather, the implement is towed by the tractor and the brush is driven by a tractor power take-off drive. To increase the brush rotational speed, again to augment scrubbing action, a gearbox, or power transfer case, is installed between the tractor power take-off drive and the brush. Multiple gears allow selection of a suitable brush rotational speed. Optionally, the gear box may be dual shaft to allow each brush to be driven by an independent drive shaft.

A magnetic bar is attached transversely rearward of the housing disposed close to but spaced apart from the pavement to collect iron debris on the pavement.

DETAILED DESCRIPTION OF THE EMBODIMENTS

Figure 1:
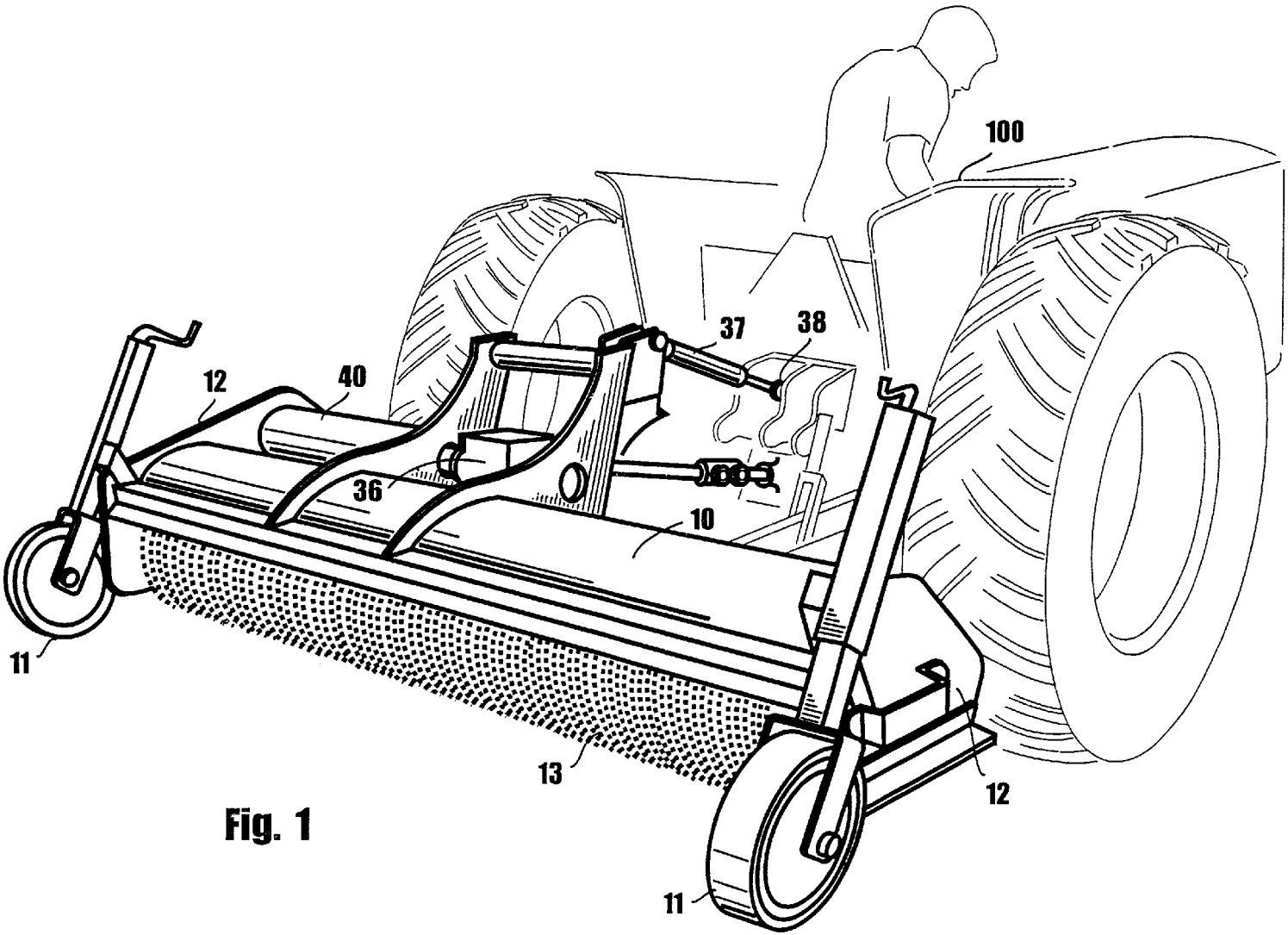
FIG. 1 is a rear perspective view of the scrubber implement pulled by a tractor.
Figure 2:
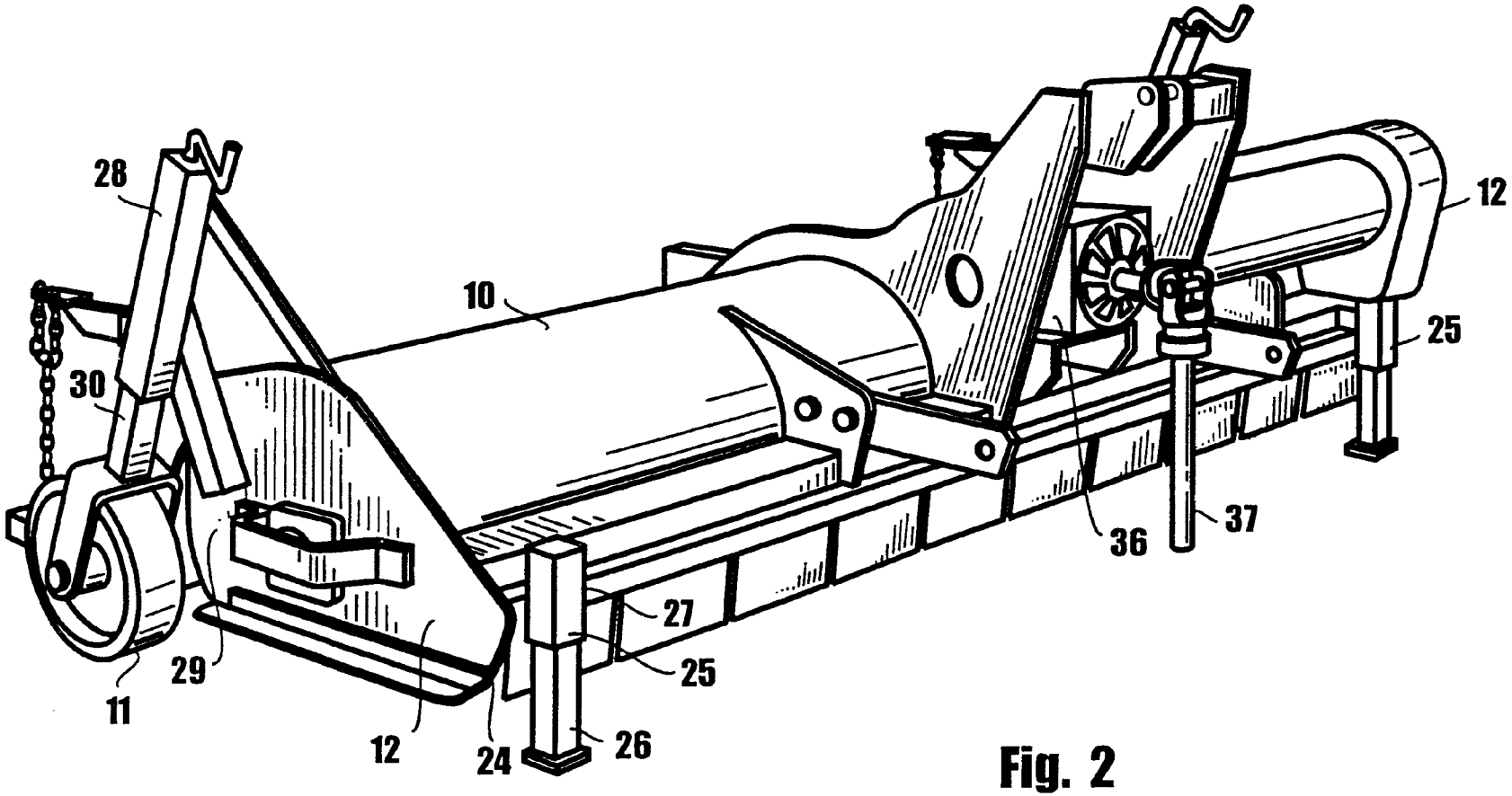
FIG. 2 is a front perspective view of the scrubber implement.
Figure 3:
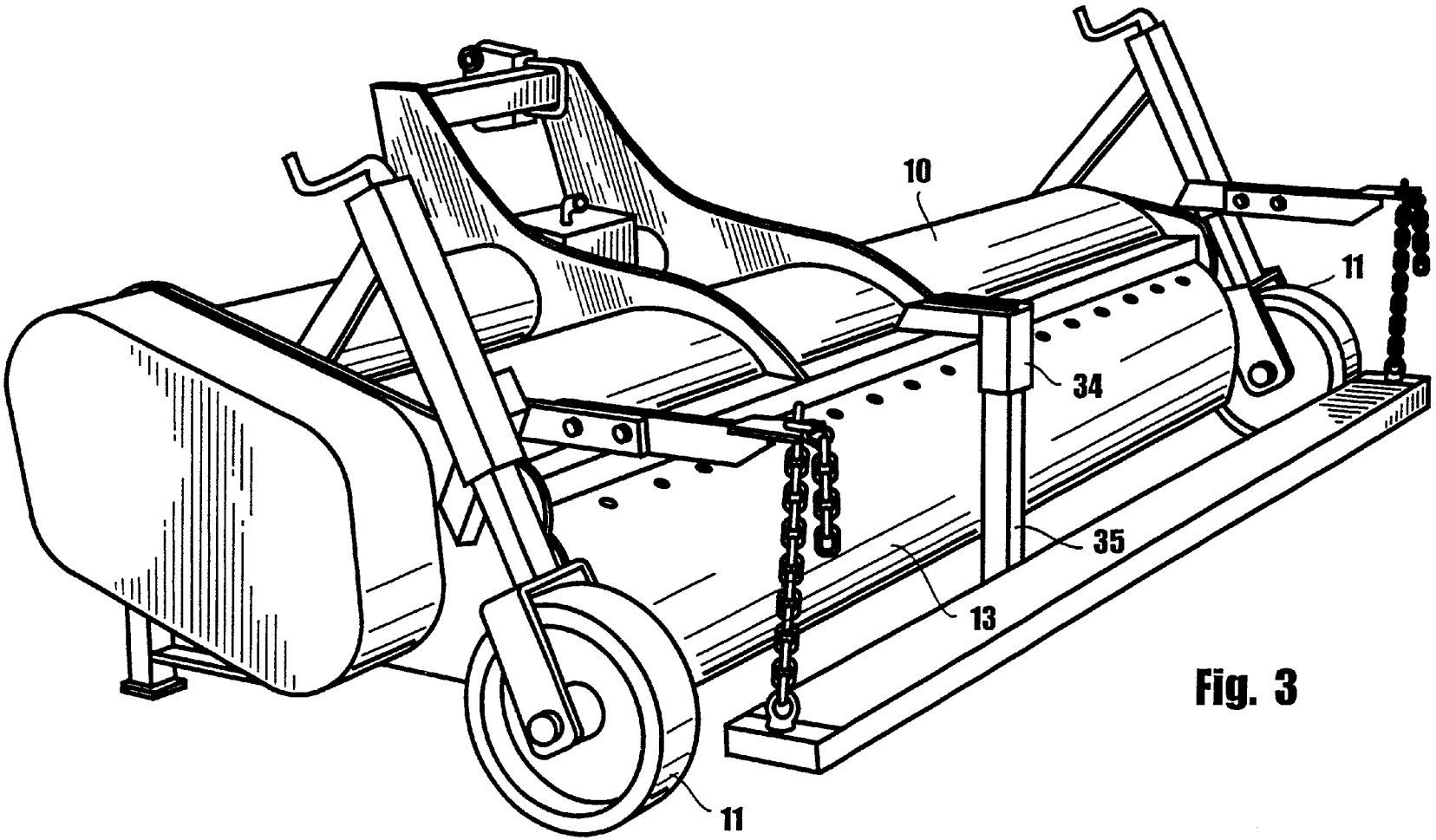
FIG. 3 is a rear perspective view showing a magnetic bar behind the implement.
Figure 4:
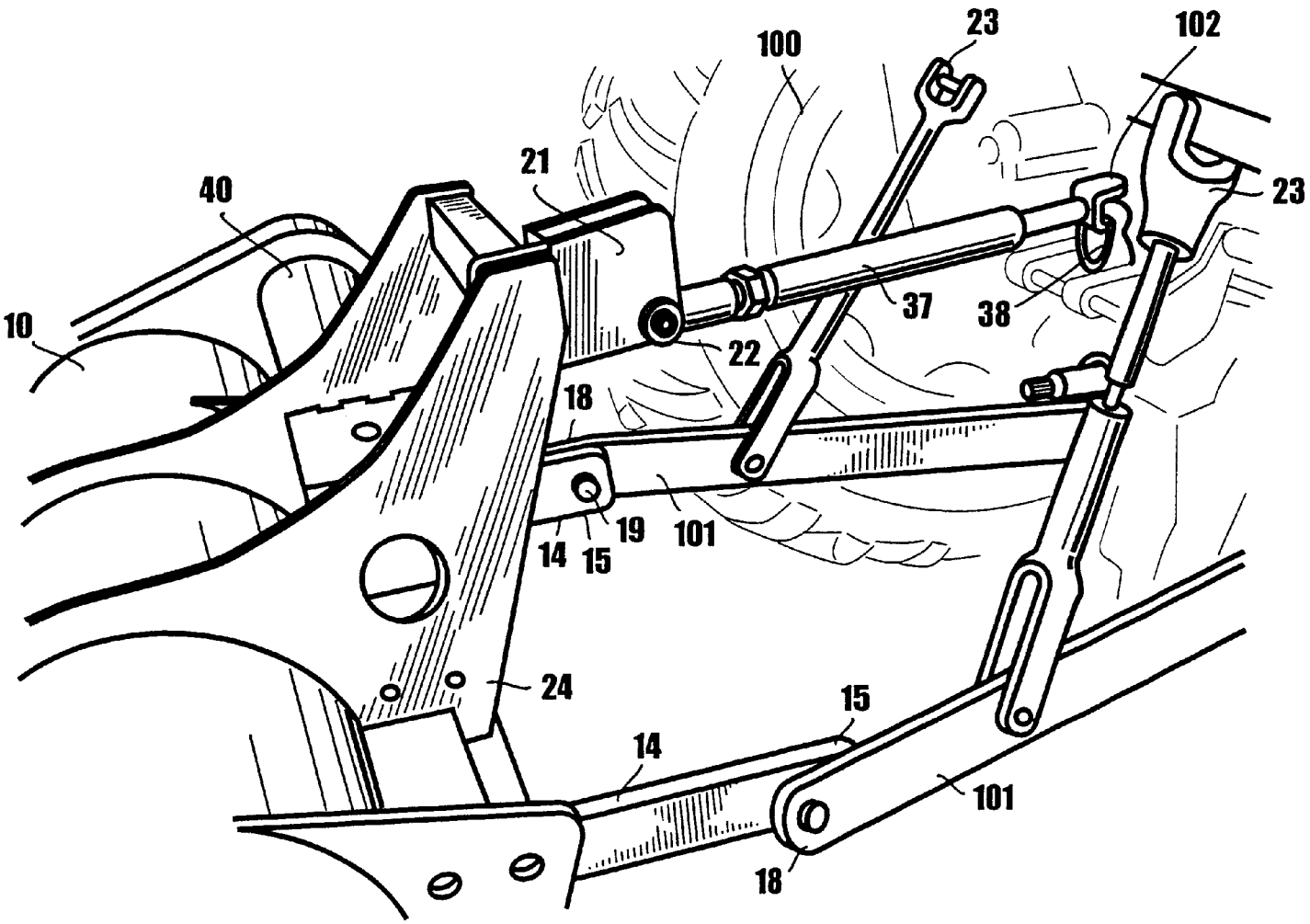
FIG. 4 is a side perspective view showing the 3-point hitch connection of the implement to the trailer.
Figure 5:
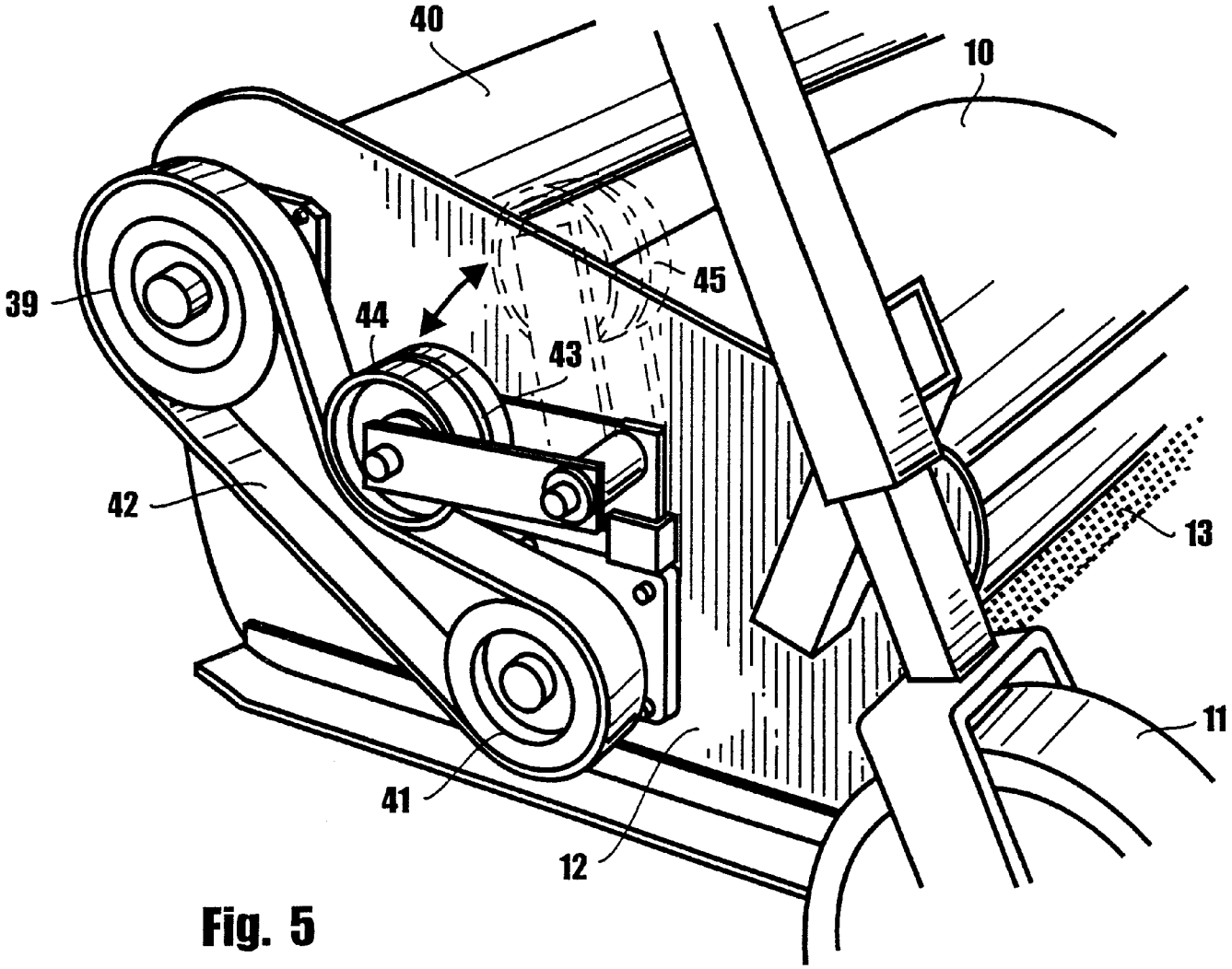
FIG. 5 side perspective view showing belt-driven pulleys with a tightening wheel.
Figure 6:
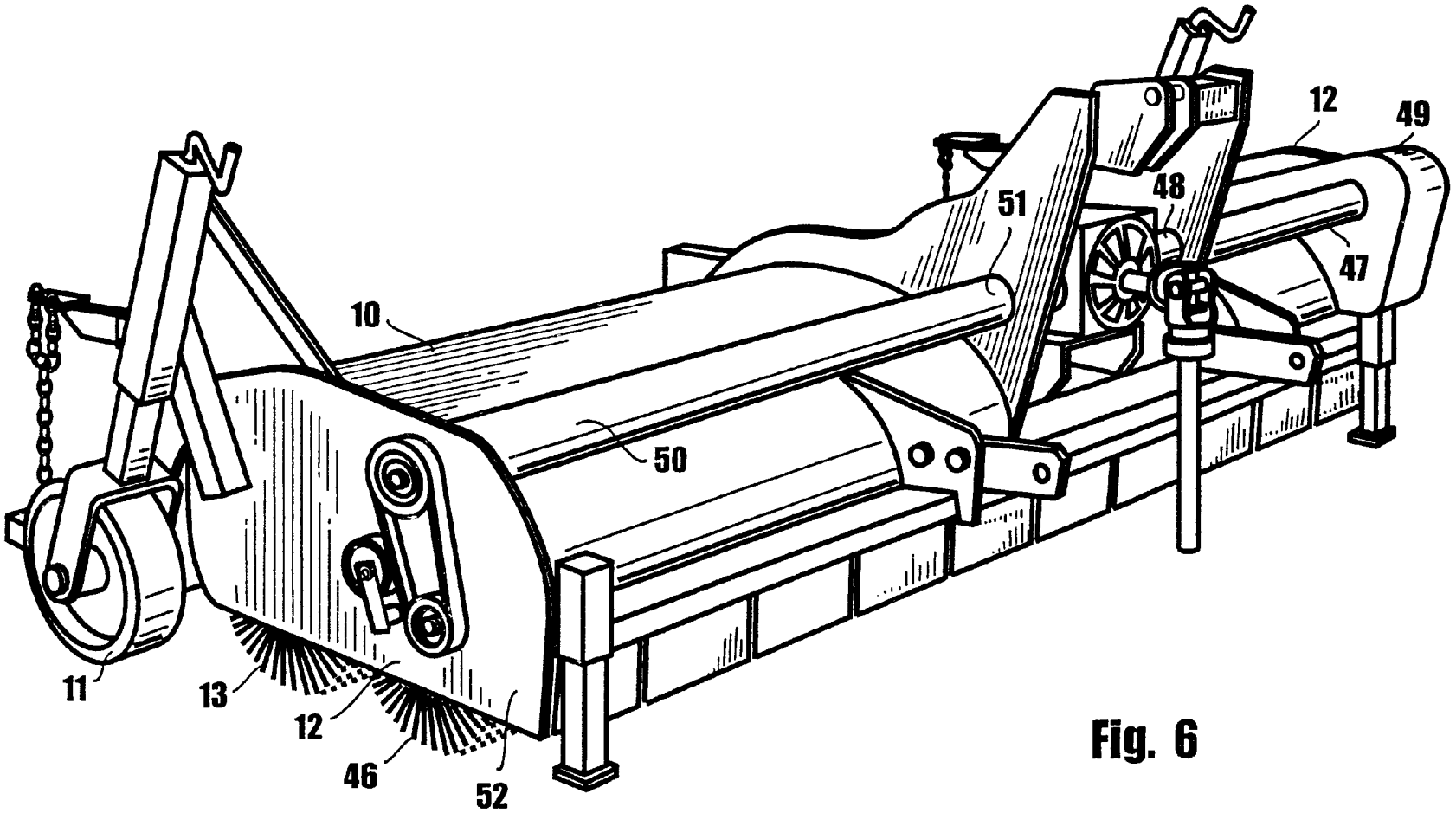
FIG. 6 is side perspective front view showing two axially-offset cylindrical brushes under the implement housing.
Figure 7:
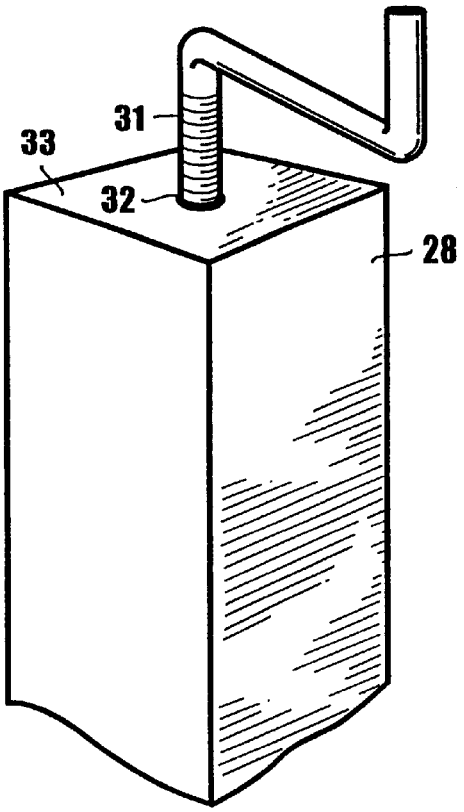
FIG. 7 is a perspective view of the wheel extension member.
Figure 8:
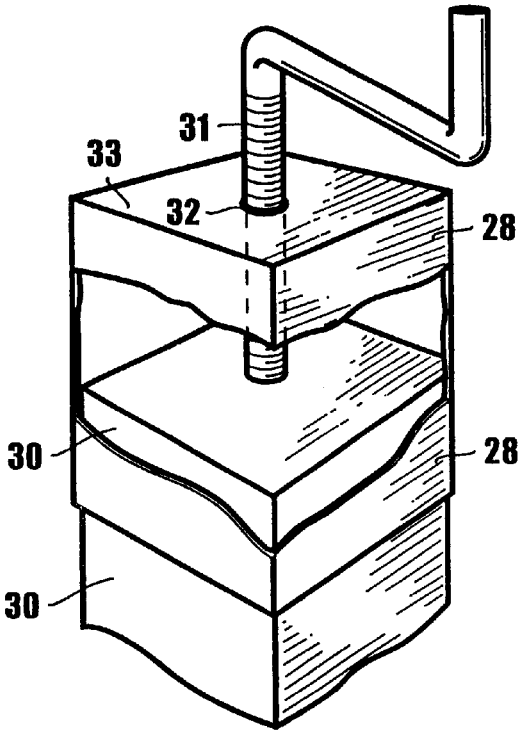
FIG. 8 is a perspective cut-away view of the wheel extension member of FIG. 7.

The tractor implement of the present invention, intended to be attached to a tractor 100 for scrubbing a drive surface, such as a runway of asphalt or concrete, includes an implement housing 10 supported by a pair of wheels 11 extending from sides 12 of the housing 10. Within the housing is a first rotating cylindrical brush 13 oriented transverse to the direction of motion of the tractor. Said wheels 11 are typically mounted rearward of the housing 10 disposed such that the wheels support the implement rearward section 8.

The implement is intended to be attached to a tractor with a 3-point hitch comprising a pair of tractor attachment members 101 extending rearward from the tractor and a third tractor attachment 102 member above the pair of tractor attachment members 101. A corresponding matching pair of housing attachment members 14 extend forward from the housing for removably receiving said pair of tractor attachment members 101 extending rearward from the tractor 100. Typically, the distal end 15 of the tractor attachment members 101 has a bore not shown in ends 18 of the housing attachment members 14. A pin 19 passes through housing attachment holes and through the bore to pivotably connect the housing attachment member 14 to the tractor attachment members 101. A central attachment means 21 is attached above and forward of the housing with a similar second pin 22 for removably and pivotably connecting the central attachment means 21 to the third tractor attachment member 102. A hydraulic cylinder 23 is disposed between the tractor and each of the pair of tractor attachment members 101 to lift and lower the pair of attachment members 101. Hence, when the pair of tractor attachment members 101 are hydraulically actuated to lift and lower the housing attachment members 14, the housing 10 is lifted and lowered at its forward portion 24, pivoting on the wheels 11. With the brush 13 inside the housing 10 and the housing 10 between the wheels 11 and the tractor 100, as the implement forward section 9 is thus raised and lowered, the brush is brought into engagement and disengagement with the pavement surface. The brush may also be further urged down to the pavement by the tractor attachment members 101 to increase a brush scrubbing action.

A pair of retractable support stands 25 are forward on housing sides 53 to support the housing forward portion 7 when it is not connected to a tractor. Support legs 26 telescope from within a stand tubular section 27 to engagement with the pavement to support the housing 10. When the housing 10 is connected behind a tractor the tractor supports the forward portion, and the support legs 26 are retracted from the pavement and into the stand tubular sections 27.

The implement is maintained adjustably at a selective position above the runway by means of adjustment of height of the wheels 11, wich adjustment is effected by extension of the wheels from the housing 10. Similar to the stand tubular section 27 and support legs 26, a wheel tubular section 28 is attached to the housing 10 at its rearward portion 29. A wheel extension member 30 telescopes out of the wheel tubular section 28 to a wheel 11 that rests on the pavement. Typically, a threaded rod 31 extends through a matching threaded hole 32 in the top 33 of the tubular section 28 and into the tubular section. The wheel extension member rests 30 then against the rod 31. Thus, as the rod 31 is screwed into the tubular section 28, it pushes the wheel extension member 30 out of the tubular section 28 pushing the wheel 11 further from the housing 10 therein lifting the housing further from the ground. To facilitate wheel extension adjustment, a rearward telescoping support stand 34, in like manner of the forward support stands, is provided on and rearward of the housing 10. In practice, when the height of the wheels is adjusted a support leg 35 is extended from a tubular section and then retracted as the housing is again supported by the wheels 11.

A power transfer case 36 is mounted forward on the housing 10 and receives a drive shaft 37 connecting a tractor power take-off 38 with the drive shaft 37. An first pulley 39 is connected to a power transfer shaft 40 exiting the case 36. Gears in the case (not shown) regulate the rotation of the shaft and pulley. A second pulley 41 in alignment with the first pulley 39 is connected to the brush 13. A belt 42 wraps between the two pulleys to transfer power from the case 36 to the brush 13. For purposes of this description, the terms belt and pulley are deemed to include chain and sprocket and other similar or equivalent drive means. A belt tightening wheel 43 is mounted on the housing 10 between the pulleys 39 and 41 such that in a first position 44 the tightening wheel 43 is against the belt 42 and tightens the belt such that the brush 13 and second pulley 41 are rotated by rotation of the first pulley 39. The tightening wheel second position 45 is away from the belt 42 such that the belt is not tightened by the tightening wheel 43 thereby disengaging the drive means from the brush 13.

In a second embodiment, a second rotating cylindrical brush 46 is mounted parallel and axially offset to the first brush 13. The second rotating cylindrical brush 46 is also mechanically connected to and driven by the power transfer case 36 such that it rotates counter to the rotation of the first brush 13 to improve scrubbing action. Typically, one drive 47 exits the power transfer case from one side 48 to drive pulleys on a first housing side 49 and a second drive 50 exits the power transfer case 36 from its other side 51 to similarly drive pulleys on a second housing side 52. As with the single brush embodiment, the pulleys driven from the power transfer case 36 are connected to pulleys connect coaxially with the respective brushes by means of a drive belt tightened by a tightening wheel, or optionally released in practice to disengage one or both brushes.

Having described the invention, what is claimed is as follows:

1. An implement adapted to be pulled by a tractor having a power take-off drive and detachable therefrom and further adapted to scrub a drive surface, comprising, an implement housing with sides, a pair of supporting wheels extending from the housing sides disposed to support the housing, a rotating cylindrical first brush substantially within the housing, attachment means on the housing for attaching the implement behind a tractor, means for adjustably maintaining the implement at a selective position above the drive surface, a power transfer means on the housing mechanically connected to the brush and adapted to receive a drive shaft from the tractor power take-off drive for transferring power from the tractor power take-off drive to the brush, a pair of housing attachment members extending forward from the housing for removably receiving a pair of matching tractor attachment members extending rearward from the tractor, each with means for connecting a housing attachment member with a corresponding tractor attachment member.

2. The tractor implement of claim 1 further comprising a central attachment means on the housing for receiving a a third tractor attachment member in attachment between the housing and the tractor.

3. The tractor implement means of claim 2 in which the housing attachment members and central attachment means are pivotably connected to the tractor attachment members such that by actuating the tractor attachment members, the housing is lifted and lowered thereby adjusting the brush into engagement and disengagement with the pavement surface.

4. The tractor implement means of claim 1 further comprising a pair of retractable support stands on the housing adapted to move between a retracted position and an extended position and further adapted to support the implement in concert with the wheels when the support stand is in said extended position.

5. The tractor implement of claim 1 in which the supporting wheels further comprise a means for adjusting the extension of the wheels from the housing.

6. The tractor implement means of claim 1 in which said power transfer means includes a first pulley connected to the drive means and a second pulley connected to the brush, a belt between the two pulleys and a belt tightening wheel with at least two positions with a first position against the belt adapted to tighten the belt such that the brush and second pulley are rotated by rotation of the first pulley by the tractor power take-off drive and with a second position away from the belt such that the belt is not tightened thereby disengaging the tractor power take-off drive from the brush.

7. The tractor implement of claim 1 in which the brush rotates counter to the rotation of the supporting wheels.

8. The tractor implement of claim 1 further comprising a rotating cylindrical second brush parallel to the first brush.

9. The tractor of claim 8 in which the second rotating cylindrical brush is connected to the power transfer means such that it rotates counter to the rotation of the first brush.

10. The tractor implement of claim 1 wherein the power transfer means further comprises a gear assembly between the power take-off drive and the brush adapted to rotate the brush at selective speeds.

11. The tractor implement of claim 1 further comprising a magnetic bar rearward of and transverse the housing.

12. A combination of a tractor having a tractor power take-off drive and a tractor implement for scrubbing a drive surface comprising, a implement housing with sides, a pair of supporting wheels extending from the housing sides to support the housing, a rotating cylindrical first brush substantially within the housing, a pair of tractor attachment members extending rearward from the tractor with means in the tractor for lifting and lowering said pair of tractor attachment members, attachment means for attaching the implement behind a tractor, comprising a pair of housing attachment members extending forward from the housing for removably receiving said pair of tractor attachment members extending rearward from the tractor, each with means for connecting a housing attachment member with a corresponding tractor attachment member, a central attachment means attached on the housing for receiving a third tractor attachment member in pivotable attachment between the housing and the tractor, the attachment members and central attachment means pivotably connected to the tractor attachment members such that by actuating the pair of tractor attachment members, the housing is lifted and lowered thereby adjusting the brush into engagement and disengagement with the pavement surface, means for adjustably maintaining the implement at a selective position above the runway, a power transfer means adapted to transfer power from the tractor power take-off drive to the brush, a pair of retractable support stands on the housing adapted to move between a retracted position and an extended position and further adapted to support the implement in concert with the wheels when the support stand is in said extended position.

13. The tractor implement of claim 12 which the supporting wheels further comprise a means for adjusting the extension of the wheels from the housing.

14. The tractor implement means of claim 12 in which said power transfer means includes a first pulley connected to the drive means and a second pulley connected to the brush, a belt between the two pulleys and a belt tightening wheel with at least two positions with a first position against the belt and adapted to tighten the belt such that the brush and second pulley are rotated by rotation of the first pulley by the tractor power take-off drive and with a second position away from the belt such that the belt is not tightened thereby disengaging the tractor power take-off drive from the brush.

* * * * *